United States Patent [19]

Schroeder et al.

[11] Patent Number: 4,725,235

[45] Date of Patent: Feb. 16, 1988

[54] MARKSMANSHIP TRAINING APPARATUS

[75] Inventors: James E. Schroeder, San Antonio, Tex.; Arthur D. Osborne, Columbus, Ga.

[73] Assignee: The United States of America as represented by the Secretary of the Army, Washington, D.C.

[21] Appl. No.: 805,023

[22] Filed: Dec. 5, 1985

[51] Int. Cl.[4] ..... G09B 9/00

[52] U.S. Cl. ..... 434/18

[58] Field of Search ..... 434/18

[56] References Cited

U.S. PATENT DOCUMENTS 4,050,166 9/1977 Swiatosz et al. ..... 434/18

*Primary Examiner*—Leo P. Picard

*Attorney, Agent, or Firm*—John H. Raubitschek; Francis A. Cooch; Werten F. W. Bellamy

[57] ABSTRACT

The embodiments of the invention provide mechanical and electrical apparatus for inexpensively and swiftly converting conventional firearms temporarily into marksmanship training devices. Illustratively, a number of different devices are shown for attaching marksmanship training and scoring apparatus to the weapon or weapon launcher and to enhance training realism without expending ammunition. Electrical circuits for improved marksmanship training and scoring also are shown and described.

3 Claims, 10 Drawing Figures

MARKSMANSHIP TRAINING APPARATUS

CROSS-REFERENCE TO RELATED APPLICATION

James E. Schroeder, U.S. patent application Ser. No. 646,322, filed Aug. 31, 1984, for "Light Pen Marksmanship Trainer".

BACKGROUND OF THE INVENTION

This invention relates to training devices and, more particularly, to adaptors for temporarily attaching marksmanship scoring devices to conventional firearms as well as the electrical circuits associated with these scoring devices, and the like.

Marksmanship training devices have been in use almost as long as firearms. The need for training devices of this nature arises from many sources. Thus, in its initial stages, at least, marksmanship training is much more effective if it is conducted in a relatively calm, stress-free atmosphere, away from the obvious tensions of the firing range and the presence of "live" or "ball" ammunition. Cost reduction is another important consideration in the application of training devices to firearms proficiency. Illustratively, ammunition, even "training" ammunition, is expensive not only on a unit cost basis, but also from the standpoint of transportation, storage, accountability control and issue.

There is the further problem of the availability of suitable firing ranges. Certainly, for many modern weapons, ranges must be large. In these circumstances, there are first, a limited number of possible ranges that can be used for "live firing" training purposes. Range utilization scheduling, the expense, time and inconvenience in moving troops and equipment to and from these facilities are, to identify just a few reasons, further examples of the very pressing need to develop realistic alternatives to "live firing" exercises.

In earlier copending U.S. patent application Ser. No. 646,322, filed Aug. 31, 1984 and entitled "Light Pen Marksmanship Trainer", a system is described in which a "light pen" is clamped to the muzzle of a weapon. The "light pen" and weapon are aimed at a microcomputer generated target on the screen of a television monitor. Responding to the activation of the trigger, the microcomputer calculates the proper trajectory of the simulated "round" based upon the orientation of the "light pen" relative to the screen at the time of trigger activation in order to generate and display the calculated shot impact point for the benefit of the user.

Unquestionably, there is a need for an adaptor that can temporarily attach the light pen and other associated aiming and trigger operation switches to one or more of the large number of hand-held and aimed weapons that characterize military arms inventories, of which light antitank weapons and grenade launchers are typical. Further in this regard, there also is a need for some device that will simulate the recoil and vibration of a weapon when it is actually being fired as well as a more rugged computer program cartridge to withstand the hard use that usually is associated with military training conditions. With respect to the electrical circuits that relate to this training device, it is indeed desirable to show on the television screen an actual film of a combat scene in contrast to artificial, computer generator figures. Because the "light pen" responds to the luminous intensity of the screen, however, the color images produced by a film displayed on a television screen will result in unreliable "light pen" responses. Consequently, there is a great need for some technique that will permit a color film presentation of a combat scene for more realistic training without adversely effecting the operation of the marksmanship scoring circuit.

SUMMARY OF THE INVENTION

These and other marksmanship training device problems that have characterized the prior art are overcome, to a great extent, through the practice of the invention.

Illustratively, a clamp is provided that has two sets of attaching straps, one set for attaching the clamp to the weapon and the other set for attaching the "light pen" to the clamp. In this manner, one expensive "light pen" can be quickly attached to or detached from a number of weapons of different type through a relatively inexpensive clamp. Further developments of this clamp, moreover, enable the "light pen" to be temporarily connected to large tube weapon launchers, e.g., a light antitank weapon or a grenade launcher.

To translate trigger activation into an electrical signal that completes the scoring function of the marksmanship training device, adaptors are provided, in accordance with the invention to modify the ignition switch in a light antitank weapon and the firing pin mechanism of a grenade launcher. As an additional feature of the invention, an adaptor is provided for the "light pen" and grenade launcher combination in which the "light pen" is parallel with the line of sight through the launcher's quadrant sight.

Realism in training simulators of the nature described herein is increased through a special shoulder stock insert in which a solenoid or rotating hammer impacts a kick plate in response to trigger activation. The kick plate, pressed against the shoulder, couples the appropriate "kick" or "buck" to the user, or trainee.

The modern emphasis on automatic weapons provides a still further opportunity for training simulation. Thus, another development of the invention provides a device that reproduces the recoil and vibration of an automatic firearm in a manner that permits the cyclical rate of recoil and vibration to be varied to match any one of several weapons to which the device can be attached. Typically, a rotating arm selectively impacts a solenoid controlled hammer within an apparatus that can be attached to any one of automatic weapons. A mechanism for varying the rotational speed of the drive for the arm provides the flexibility required to match the rate of recoil and vibration of the device to the particular weapon to which it it attached.

To better protect the program that controls the electrical target generation and simulated scoring circuit for the training device, a program on a tap within a cartridge, or cassette, is coupled to this computer in preference to the "floppy disk" or "hard disk" drives. In this way, a more sturdy means for providing the program is made available with an apparatus that is both less expensive and less sensitive to dust than that which has heretofore been available.

To enable a motion picture of a combat scene to be generated on the television monitor, the image on the screen is divided into a realistic film of an actual combat situation and, preferably, on the lower portion of the picture tube, a band of one solid color is produced. The light pen is aimed at the solid color band. In this manner, light pen scoring accuracy is maintained because the variety of colors and screen brightnesses in the combat scene on the upper portion of a the monitor do not influence the electrical response of the pen.

As those who are familiar with small arms training know, proper trigger "squeeze" is an important element of marksmanship accuracy. If the trigger is "jerked", the trainee will pull the firearm out of proper alignment with the target and register a "miss." Consequently, a further feature of the invention provides a mechanical device for attachment to the trigger guard of a magazine-type weapon that converts the movement of the trigger into an electrical signal that registers the proper "squeeze" or "jerk." In this manner, the trainee is made immediately aware of the correct or incorrect character of the trigger manipulation.

Thus, there is provided through the practice of the invention an improved simulator for marksmanship training for application to a broad range of weapons, all at low cost. For a more complete appreciation of the invention, attention is invited to the following detailed description of a preferred embodiment of the invention. The scope of the invention, however, is limited only through the claims appended hereto.

DETAILED DESCRIPTION OF THE PREFERRED EMBODIMENTS

Figure 1:
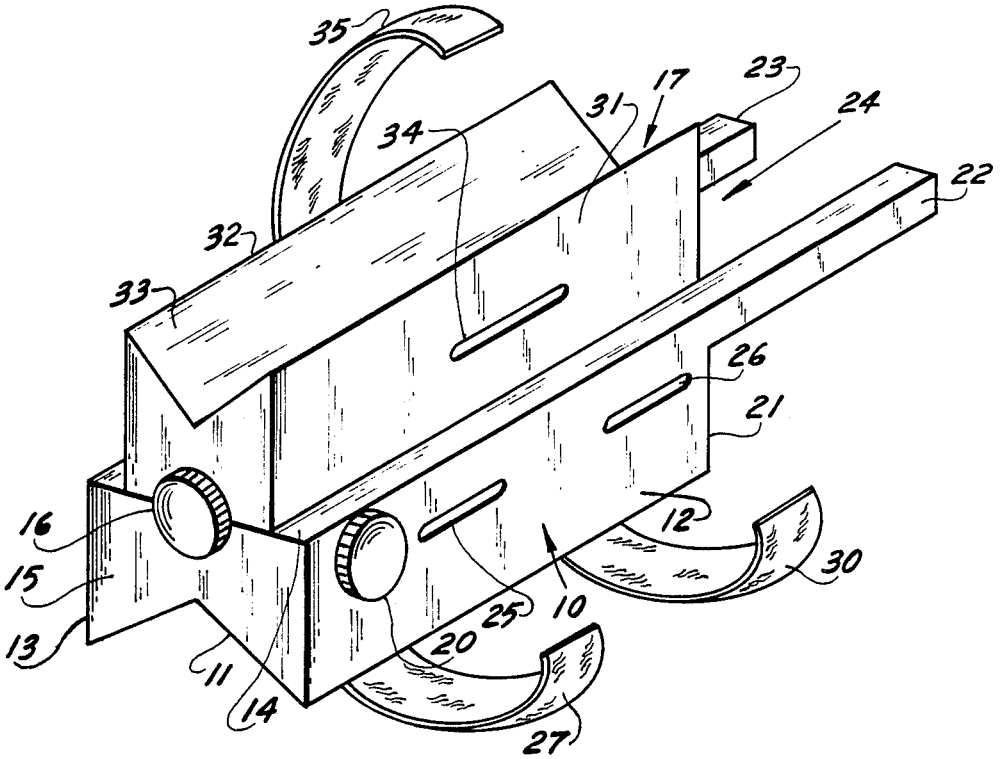
FIG. 1 is a perspective view of a typical apparatus that embodies features of the invention for clamping a light pen to a weapon.

For a more detailed understanding of the invention, attention is invited to FIG. 1 which shows a typical apparatus for clamping a light pen (not shown) to the barrel of a rifle, or the like (also not shown), of which the "M-16" is typical. Illustratively, a generally rectilinear block 10 has an inverted, lengthwise "V" shaped trough 11 formed in a longitudinal surface. The trough 11, moreover, is of sufficient depth and breadth to straddle a barrel on any one of several conventional rifles in a manner that establishes a line of tangent contact between each of the diverging sides of the trough with that portion of the barrel that is nested in the trough. Instead of trough 11, a variation (not shown) of the invention consists of a lengthwise hole formed in block 10 permitting placement of the barrel of the rifle or weapon through block 10.

Parallel sides 12,13 extend from the divergent longitudinal edges of the trough 11 to a transverse adjustment surface 14. As shown the surface 14, the forward, or muzzle end 15 of the block 10 has a transverse adjustment knob 16 for pivoting a light pen block 17 transversely to the left or to the right, as seen in FIG. 1, in order to adjust where the light pen is aimed to a designated portion of a target, e.g., a television monitor, as well as to adjust for individual differences attributable to each weapon and training program. The mechanism (not shown) associated with the transverse knob 16 can be any suitable apparatus that would permit the light pen block 17 to pivot in a desired direction in response to graduated, ratcheted rotation of the knob.

An elevation adjustment knob 20 also is secured to the side 12 of the block 10 near the transverse muzzle end 15 in order to further compensate for the distance between the rifle and the target as well as, once more, to accommodate the specific idiosyncracies of a particular weapon and training program. The elevation adjustment knob 20 employs a ratcheted mechanism (not shown) for moving the associated portion of the light pen block 17 toward or away from the adjustment surface 14 to provide the required degree of sight adjustment compensation.

Continuing with the description of the block 10, a transverse magazine or receiver end 21 terminates in a pair of longitudinally protruding support bars 22,23. In the embodiment of the invention under consideration, the bars 22,23 each protrude from the respective sides 12,13 of the block 10, forming extensions of the adjustment surface 14. Thus, the bars 22,23 create a bight 24 that straddles the front sight post of the firearm to which the light pen is to be temporarily attached.

A pair of transverse, strap receiving slots 25,26 are formed at the muzzle end 15 and the receiver end 21, respectively of the block 10. Companion straps 27,30 also are attached to the side 13, each in alignment with its associated one of the slots 25,26. The lengths of the straps 27,30 are sufficient to extend around adjacent portions of the forearms, or barrels of any one of the rifles to which the clamp is to be attached; pass through the respective slots 25,26 and fasten through suitable means that are not shown in the drawing on the side 13.

The light pen block 17, which as mentioned above is mounted for controlled movement on the adjustment surface 14, also is a rectilinear member, albeit of smaller dimensions than the block 10 to which it is attached. Two longitudinally disposed parallel sides 31,32 extend from the adjustment surface 14 to terminate in respective lengthwise diverging edges of a "V" shaped light pen trough 33. The trough 33 has sufficient depth and dimensions to establish longitudinally tangent line contact between each of the sides of the trough and a light pen (not illustrated) that is received within the trough.

A transverse slot 34 is formed in the middle portion of the block 17. The slot 34 is adapted to receive the bitter end of a strap 35. One end of the strap 35 (not illustrated) is attached to the parallel side 32 in general alignment with the slot 34. The length of the strap is adequate to pass over the surface of the light pen (not shown), pass through the slot 34 and secure through an appropriate buckle, or the like, to the side 32.

In operation, the trough 11 is placed over the rifle barrel, the front sight of the rifle being nested between the protruding support bars 22,23. The straps 27,30 are drawn tightly around the forward stock of the rifle, passed through the associated slots 25,26 and fastened tightly to the surface 13. This apparatus and procedure not only binds the clamp securely to the rifle, but because of the linear contact between the sides of the trough 11 and the rifle barrel and the nested position of the rifle's front sight in the bight 24 between the support bars 22,23 also aligns the clamp with the sighting axis of the firearm.

A light pen is placed in the trough 33 with the electro-optically active end of the pen (also not shown) oriented toward the muzzle end of the apparatus. The strap 35 is passed over the adjacent outer surface of the light pen, inserted through the slot 34 and fastened securely to the side 32.

Thus, the clamp attaches a light pen to a conventional weapon in a manner that is secure and in general sight alignment. The transverse knob 16 and the elevation adjustment knob 20 are manipulated to ready the rifle for simulated "fire". In this way, one relatively expensive light pen can be swiftly attached to any one of a number of different weapons and different types of weapons. This broad adaptability significantly reduces, moreover, the number and variety of clamps required in order to provide even further cost savings, smaller parts inventories and the like.

To remove the clamp, it is only necessary to release the strap 35 over the light pen and withdraw the light pen from the trough 33. The straps 27,30 that attach the clamp to the rifle are also released, thus freeing the clamp from the weapon for storage or use on another firearm.

Figure 2:
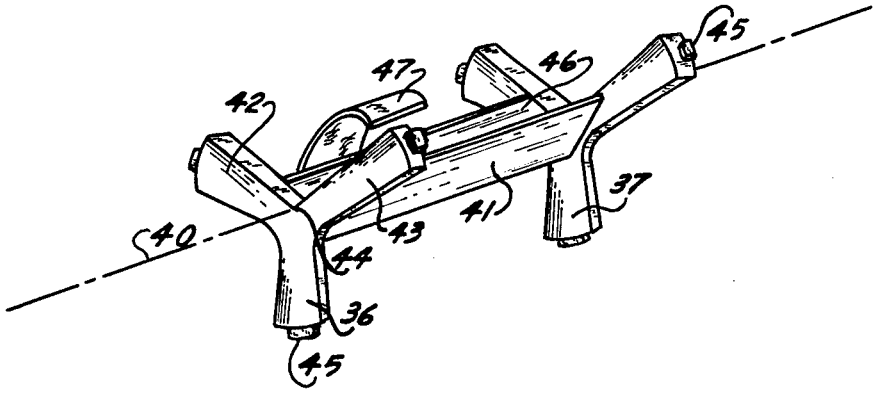
FIG. 2 is a perspective view of another apparatus, embodying principles of the invention, for clamping a light pen to large tube weapons.

Attention now is invited to FIG. 2 which shows a light pen clamp for application to large tubed weapons, of which the M72 A2 Light Antitank Weapon (LAW) is typical. In broad general terms, "conventional" ammunition costs are proportional to the cube of the munition's radius. Consequently, as the diameter of the munition increases the cost of that munition increases by the cube. Consequently, the need for inexpensive and realistic training simulation devices is even greater for these larger tube weapons. Accordingly, for application to a LAW, a pair of "Y" shaped bore spacers 36,37 are separated relative to longitudinal axis 40 of the bore of a LAW by means of a bar 41. The spacers 36,37 each have three limbs, of which limbs 42,43 are typical. All of the limbs 42,43 are at least slightly smaller in radius than the corresponding bore radius of the LAW. The limbs, moreover, converge at yoke 44 of each of the "Y" shaped spacers 36,37 to form a "V" shaped slot which is in general alignment with the longitudinal axis 40. The extremeties of all of the limbs 42,43, as shown in the drawing, are provided with spring biased tips 45.

Referring once more to the slot in the yoke 44, the bar 41 that separates the bore spacers 36,37 has a "V" shaped trough 46, also in general alignment with the longitudinal bore axis 40. The bar 41 is rigidly secured to the opposing surfaces of the bore spacers 36,37 and is provided in its midsection with a light pen strap 47.

In operation, a light pen (not shown in the drawing) is placed lengthwise in the trough 46 of the bar 41 and the strap 47 is drawn tightly over the adjacent surface of the light pen. The strap is secured by buckling, or the like, to fix the light pen temporarily, albeit rigidly in place within the trough 46. Thus secured, the clamp is introduced into the bore of the LAW, the spring biased tips 45 generally aligning the yoke 44, the trough 46 and the light pen with the bore's longitudinal axis 40.

The light pen, mounted in the foregoing manner within the bore of the weapon now is ready to be used in its usual marksmanship trainer simulation function. The "Y" shape of the bore spacers 36,37 is particularly advantageous for the purpose of the invention because it enables the clamp to be grasped manually for both insertion into and extraction from the LAW tube. Consequently, after the training session is completed, the spacer 37, for example, is grasped and withdrawn from the bore of the weapon. The strap 47 is released and the light pen is removed from the trough 46. In this way, one light pen and simulation apparatus can be made to service a number of weapons for training purposes.

Figure 3:
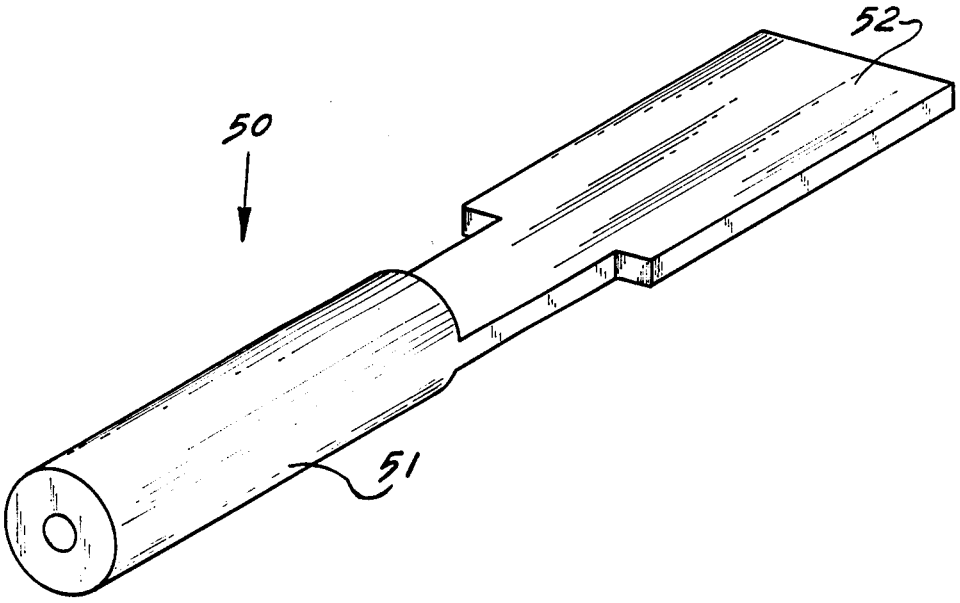
FIG. 3 is a simulation adaptor for the trigger switch in a typical light antitank weapon, in accordance with the invention.

FIG. 3 shows a trigger switch adapter 50 for a LAW training simulator. The purpose of this switch is to convert the mechanical action of the LAW trigger into the completion of a circuit (not shown) through an electrical switch that activates the light pen (not shown) to reflect "firing" the weapon. The adapter 50, made of hard steel, replaces the plastic shaft in a normally open SPST switch of the type sold under Catalog No. 275-1547 by Radio Shack and shown in connection with the illustrative embodiment of the invention shown in FIG. 4.

As illustrated, the adapter 50 has a hollow cylindrical portion 51 that is joined at one end to a rectangular paddle shaped member 52. To convert the SPST switch in accordance with the invention, the plastic switch shaft (not shown) is removed and the ends of the threads on the switch (also not shown) are filed down by about 0.235 cm.

The two screws (not shown) that retain the cover on the original LAW ignition switch are removed and the white plastic ignition housing (also not shown) is removed, too. The brass is then taken from the ignition housing and the plastic ignition housing is further hollowed out to provide a casing for the new SPST switch. The new SPST switch is secured in the plastic casing and the switch adapter 50 is mounted in the switch.

The SPST switch with the adapter 50 is inserted into the LAW (not shown). In accordance with the invention, the rectangular paddle shaped member 52 is introduced into the casing that holds the rectangular firing rod (not shown). The switch conductors are placed in the tube of the LAW through an existing aperture in that device and are connected to the light pen (not shown). The cover and screws for the ignition switch are mounted in place in order to secure the new switch in position.

In operation, the actual trigger and firing mechanism of the LAW are employed to activate the light pen in a realistic simulation of firing activity without expending expensive, live ammunition in a manner that does not change the outward appearance of the weapon. This switch adapter further permits an expended LAW tube—which ordinarily would be thrown away—to be used as a component in an effective training simulator system.

Figure 4:
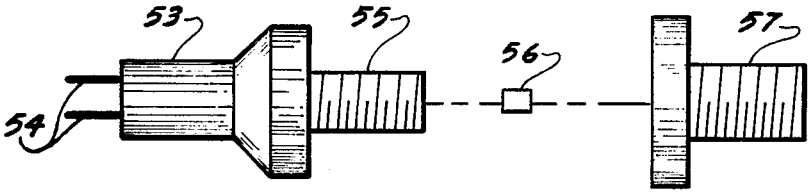
FIG. 4 is a simulator switch adaptor for a grenade launcher.

The M203 Grenade Launcher also can be modified swiftly and inexpensively for use with a light pen marksmanship trainer. The switch adapter for this grenade launcher, as illustrated in FIG. 4, includes a momentary "on" SPST switch 53 that has at one end a pair of conductors 54 that transmit a "switch closed" signal to the light pen to indicate that the grenade launcher has been "fired". At the opposite end of the switch 53 a threaded coupling 55 is in axial alignment with a cylindrical pin, or switch to firing pin adapter 56. The pin adapter 56 and threaded coupling 55 are received in the internal threading (not shown in FIG. 4) of an externally threaded stud 57.

To assemble the switch, the firing pin (not shown) is shortened to a length that renders it incapable of firing a live round. As a further safety precaution, the launching tube (not shown) also is welded shut to prevent rounds from being loaded into or fired from the training simulator. The firing pin retainer (not shown) is removed from the weapon and the fully assembled combination of the SPST switch 53, the adapter 56 and the stud 57 substituted in its place. The external threading on the stud 57 secures the assembled device in the grenade launcher in place of the firing pin retainer which had been removed.

As illustrated, the firing pin adapter 56 permits the shortened firing pin (not shown), when released, to temporarily enable the switch 53 in response to trigger activation. Thus, the firing pin temporarily completes a circuit for the light pen (not shown) to indicate to the marksmanship training simulator that the grenade launcher has been "fired."

Figure 5:
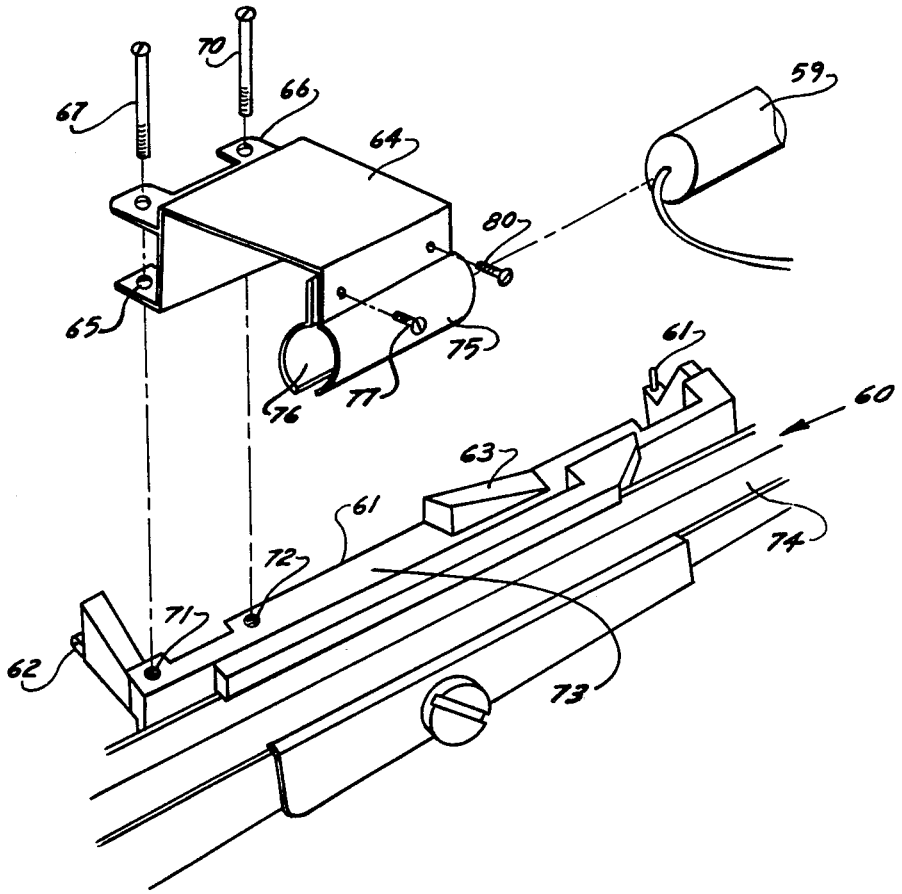
FIG. 5 is an exploded perspective view of an apparatus for temporarily adapting a light pen to a quadrant sight for a grenade launcher.

A further modification to the grenade launcher to convert this weapon into a training aid is shown in FIG. 5, in which a light pen 59 can be quickly connected to and removed from a quadrant sight 73 for the M203 grenade launcher which is attached to the M16A1 rifle 60. In adapting the light pen 59 shown in FIG. 5 to a grenade launcher of which the M203 model is typical, the longitudinal axis of the light pen must remain parallel with a quadrant sight 73, or the angle of the weapon will throw the aim of the light pen off the television screen (not shown in FIG. 5). Further in this regard, and in accordance with a feature of the invention, because front sight 61, rear sight 62 and range adjustment 63 all are on the left side of the weapon, relative to the trainee, the light pen 59 is positioned on the right side of the grenade launcher to avoid blocking access to the sights and to the range adjustment.

Thus, as shown in FIG. 5, an inverted, generally "U" shaped clamp 64 has, on one side, two sets of vertically aligned bolt holes 65,66 that accommodate a pair of bolts 67,70 that selectively secure the clamp 64 to mating threaded bolt holes 71,72 on the quadrant sight 73.

The curvature and dimensions of the clamp 64 are adequate to bridge, in a transverse direction, from the quadrant sight 73 across barrel 74 of the rifle 60 to which the grenade launcher is attached to provide, on the right-hand side of the rifle, semicircular light pen clamps 75,76. The light pen clamps 75,76, when drawn together by means of adjustment screws 77,80 form a tubular holder for the light pen 59 that aligns the light pen with the aiming axis of the grenade launcher. Although not shown, the tubular holder for the light pen, comprised of light pen clamps 75,76, can be constructed to be attached to the clamp 64 to permit the tubular holder to be adjusted both vertically and horizontally.

Consequently, the light pen firing simulation switch shown in FIG. 4 and the quadrant sight light pen clamp shown in FIG. 5 both combine to provide a means for quickly and inexpensively adapting a combat weapon to realistic training application.

Ordinarily, the more senses that can be involved in the training process the more effective training becomes. It is also generally true that many armed forces recruits, never before having fired a large-caliber weapon, are somewhat timid in handling their rifles during "live" firing exercises. This timidity interferes with efficient training and is due to many causes, not the least of which is a concern of the trainee about the recoil, or "kick" of the rifle. It necessarily follows that a training simulator making use of the senses of sight and sound (typically a light pen marksmanship trainer) would be further improved if it could be expanded to include the sense of touch in a way that inures the trainee to typical weapon recoil sensations.

Figure 6:
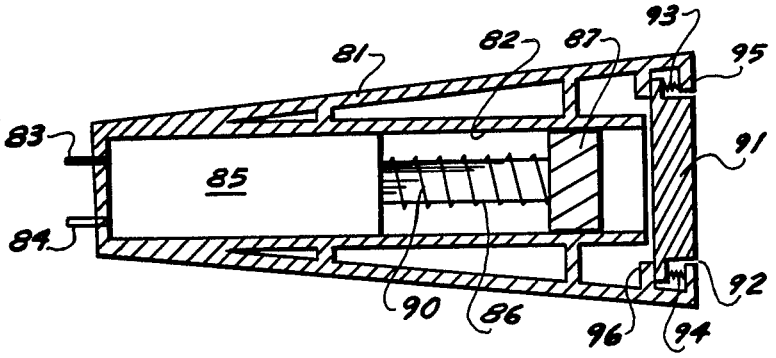
FIG. 6 is a side elevation, in full section, of a shoulder stock insert for simulating weapon recoil.

Toward this end, and in accordance with another feature of the invention, a rifle recoil simulator is shown in FIG. 6. As illustrated, a generally hollow and conical insert 81 for insertion into the butt end of a rifle stock (not shown in the figure) has a centrally disposed tubular passageway 82. The apex of the insert 81 is truncated to terminate in a pair of protruding electrical contacts 83,84 that couple a solenoid 85 to a trigger switch and power supply (both not shown). A driving rod and spring guide 86 protrudes rearwardly from the solenoid in general alignment with the axis of the insert 81.

The protruding end of the rod 86 is secured to an hammer 87. A coil spring 90 is mounted on the rod 86 in order to return the hammer to its starting position after the trigger is deactivated, as described subsequently in more complete detail. A kick plate 91 is mounted in an aperture 92 that is formed in the base of the insert 81. Biasing springs 93,94 bear against the inner surface of a peripheral flange 95 that forms the margin of the aperture 92 in order to press the kick plate 91 against a transversely protruding stop 96 within the insert 81.

In operation, upon activation of a trigger switch (not shown) the solenoid 85 stretches the coil spring 90 and drives the hammer 87 against the kick plate 91 with sufficient force to impact the shoulder of a trainee in a reasonable approximation of the recoil of a rifle. As the trigger is deactivated by being released, the electrical circuit energizes the solenoid 85 to draw the hammer 87 away from the kick plate 91 and toward the trigger and muzzle in order to prepare the mechanism for simulating another "round." The coil spring 90 which had been stretched by the solenoid 85 also assists in drawing the hammer 87 back to its starting position. To vary the simulated recoil, a potentiometer or variable resistance (not shown in the drawing) could be added to the circuit for the solenoid 85 to adjust the force of the hammer 87 and, hence, the perceived "kick" of the rifle.

The apparatus shown in FIG. 6 combines the sense of touch with the senses of sight and sound that already are available through the light pen marksmanship trainer in order to improve the efficiency of marksmanship training with a further reduction in training costs.

Figure 9:
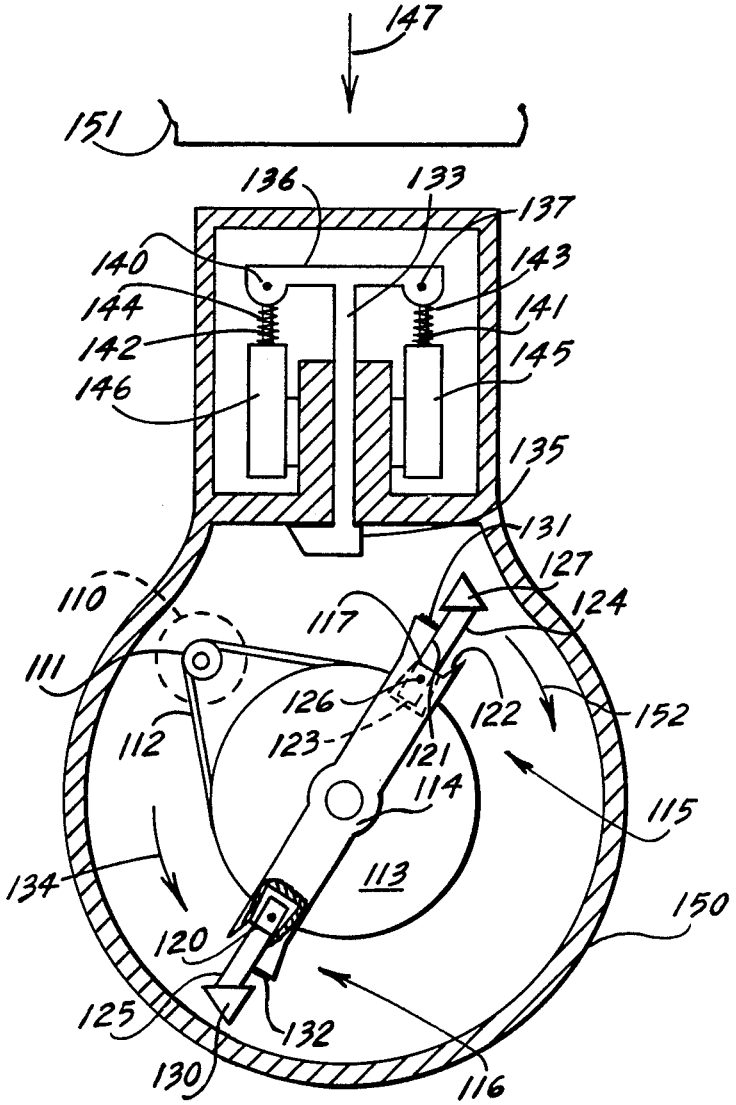
FIG. 9 is a schematic diagram of an automatic weapon recoil and vibration simulator.

Attention now is invited to FIG. 9 which shows a device for simulating not only the recoil but also the vibration of an automatic weapon. As illustrated, an electric motor 110 drives a pulley 111. A belt 112, driven by the pulley 111, transfers power to a larger diameter pulley 113. An arm 114 is diametrically disposed on the larger pulley 113 and rigidly secured to the larger pulley in order to rotate with that pulley in response to the activation of the motor 110.

As shown in the drawing, the arm 114 protrudes, on both longitudinal ends 115,116 beyond the circumference of the larger pulley 113. Both of the ends 115,116 are of essentially the same construction in accordance with a salient feature of the invention. As shown, notches 117,120 are formed in the respective ends to provide limit stops 121,122 for the notch 117 and an equivalent pair of limit stops for the notch 120. A well, or recess 123 also is formed in the base of the notch 117. A similar well, or recess is formed in the notch 120. Hammer support members 124,125, each are pivotally mounted within respective recesses, the member 124 being secured in the well by means of a pivot pin 126 to move through an arc determined by the separation between the stops 121,122, and the member 125 also being secured in a similar manner for pivotal movement relative to the limit stops formed by the notch 120.

The longitudinal extremities of each of the hammer support members 124,125 that protrude from the individual notches 117,120 each terminate in massive hammers 127,130, respectively. Biasing spring 131, moreover, draws the hammer support member 124 against the stop 121, while a similar biasing spring 132 performs the same function for the hammer support member 125.

A "tee" shaped anvil 133 ordinarily is spaced from the circumference described by rotational movement of the hammers 127,130 in the direction of arrow 134. As illustrated, the anvil 133 has a face 135 at one end of its shank that matches the corresponding surfaces of the hammers 127,130. The anvil 133 also has, at the end of the shank that is opposite to the face 135, a crosspiece 136. Each end of the crosspiece 136 terminates in respective connections 137,140 to which individual magnetically activatable combination spring guides and pole pieces 141,142 are attached. A coil spring 143,144 is mounted on pole pieces 141,142, respectively, in order to draw the face 135 of the anvil 133 out of the circumference established by the hammers 127,130 as these hammers are rotated in the direction of the arrow 134.

In order to thrust the face 135 of the anvil 133 into alignment with the rotating hammers 127,130 a pair of solenoids 145,146, each associated with respective pole pieces 141,142 are energizable. When energized, the solenoids 145,146 drive the pole pieces in the direction of arrow 147 against the forces of the coil springs 143,144 to thus push the anvil face 135 into this alignment with the hammers 127,130.

In operation, housing 150, in which the foregoing described components are mounted, is attached to a suitable connection on an automatic weapon 151. The solenoids 145,146 are electrically coupled to the weapon's trigger (not shown) in order to energize and thrust the anvil in the direction of the arrow 147 when the trigger is activated. The motor 110 also is energized in order to rotate the arm 114 in the direction of the arrow 134.

Thus, as the face 135 of the anvil 133 is thrust into the path of the rotating hammer 127, the hammer impacts on the anvil face to generate a simulated weapon recoil. The force of the biasing spring 131 is overcome by the rotational forces of the arm 114, thereby permitting the hammer 127 to pivot in a reverse direction, as illustrated by means of arrow 152, until the hammer support member 124 bears against the limit stop 122. This pivoting motion of the hammer 127, when the support member 124 engages the stop 122, provides sufficient clearance for the hammer 127 to move past the anvil face 135 after the initial impact, and to continue the rotation of the hammer in the direction of the arrow 134. After clearing the anvil face 135 in the foregoing manner, the biasing spring 131 on the end of the arm 114 draws the support member 124 and the associated hammer 127 back into contact with the limit stop 121.

A similar sequence of events occurs as the hammer 130 is rotated into contact with the anvil face 135.

Successive impacts between the hammers 127,130 and the anvil face 135 simulate both the recoil and the vibration that characterize the particular automatic weapon 151 to which the housing 150 is attached. To "cease fire", it is only necessary to release the trigger (not shown) to thereby deenergize the solenoids 145,146. Thus deenergized, the coil springs 143,144 are released to press the anvil face 135 out of the path of the hammers 127,130 and terminate the impacts that simulate recoil and vibration.

When use of the device is no longer required, the motor 110 is turned off and the housing 150 is disconnected from the weapon 151.

The flexible belt drive that is provided for this device permits a desirable degree of slippage in the entire mechanism that prevents some minor misalignment between the hammers 127,130 and the anvil face 135 from binding or jamming the device. Further in this regard, the "rate of fire" and the "recoil" force also can be varied to match the characteristics of a wide range of automatic weapons. Typically, the power rating of the motor 110, a potentiometer attached to the motor 110, the rotational speed of the hammers 127,130, the number of arms 114, and the tensions of the biasing springs 131,132 all can be varied to provide a desired result.

Figure 7:
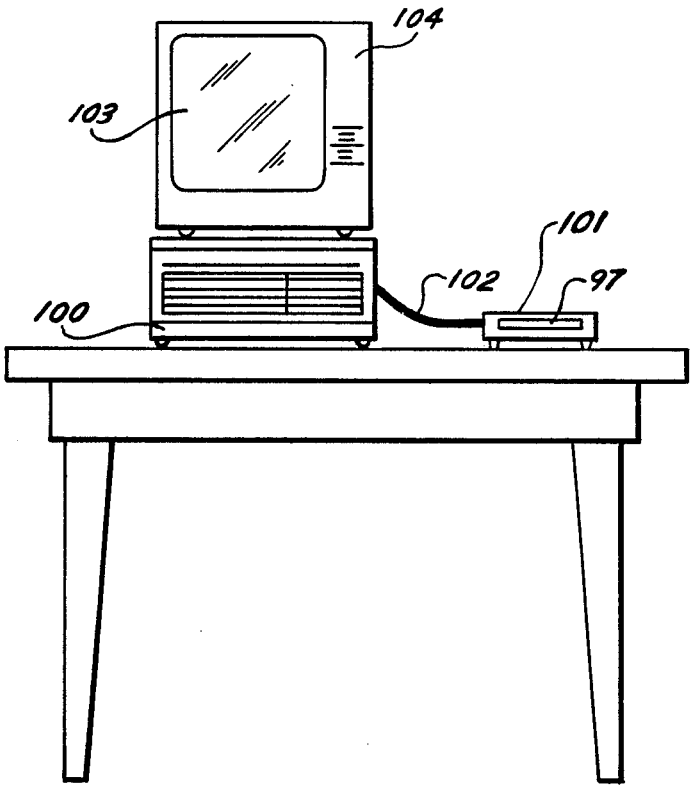
FIG. 7 is a schematic diagram of a cartridge adaptor and associated hardware for computers which otherwise do not accept PROM or EPROM memory cartridges.

FIG. 7 illustrates a cartridge adaptor that permits, in conjunction with an interface circuit, the retrieval of a light pen marksmanship training program from a PROM or EPROM memory cartridge which cartridge is more suitable to use in the field where exposure to dust, and the like, would otherwise destroy a program of this nature if it was stored on a conventional "floppy disk" or "hard disk" drive apparatus. Thus, as shown in FIG. 7, a popular computer game cartridge 97, of which the PROMS or EPROMS type is suitable, provides a program input to an host computer 100. The program from the cartridge 97 is coupled to the computer 100 through a cartridge adaptor 101 and a cable 102. An interface circuit (not shown) is contained in either the computer 100 or the cartridge adaptor 101. Consequently, by coupling the PROM or EPROM cartridge 97 to the host computer 100 through the cartridge adaptor 101 and interface circuit instead of supplying the required signal through a "floppy disk" or a "hard disk" a more field-worthy and rugged apparatus is provided to generate a marksmanship target simulation scene on a screen 103 of a ronitor 104.

Figure 8:
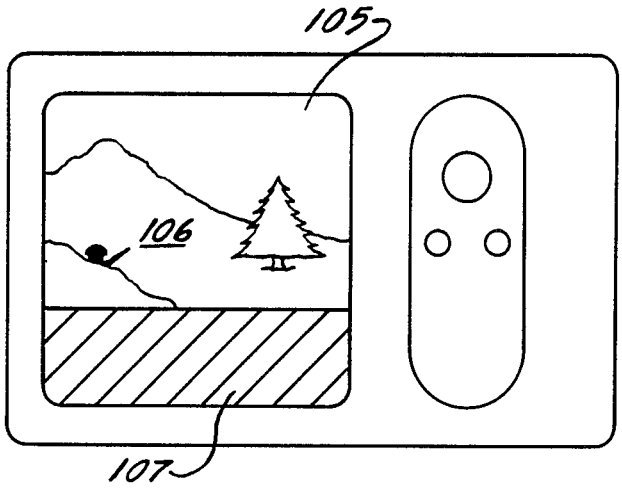
FIG. 8 is a front elevation of a television screen that displays a split screen presentation for target simulation and aiming accuracy, also in accordance with the principles of the invention.

Attention now is invited to FIG. 8 which shows an improved visual presentation for training simulation that nevertheless retains the integrity of the light pen marksmanship scoring accuracy. As previously mentioned, because of the range of screen brightnesses that characterize a prerecorded visual presentation on a monitor screen, the light pen (not shown in FIG. 8) is an unreliable scoring device. To overcome this deficiency, while still retaining the training realism of a prerecorded scene, in contrast to computer generated video targets, a signal projected onto a monitor screen 105 is divided horizontally into a filmed target sequence 106 displayed in the upper portion of the screen and a solid color presentation 107, e.g., green or white, in the lower portion of the screen.

Weapons equipped with light pen scoring apparatus (not shown in FIG. 8) are aimed by the trainee at the realistic filmed target sequence 106 projected onto the upper portion of the screen 105. The light pen, however, is actually aimed at the solid color presentation 107 in the lower portion of the screen 105. A computer (also not shown in FIG. 8) then adjusts the coordinates of the light pen aiming point on the portion 107 to coincide with the trainee's point of aim on the target sequence 106. This horizontally split presentation on the screen 105 thus preserves light pen scoring accuracy while nevertheless providing combat realism in the visual presentation on the screen 105. This split-screen effect could be created by editing the source video, e.g., videotape or videodisc, by overlaying the source video with computer generated graphics, or by other techniques.

It will be recalled that the trigger "squeeze" is an important element in small arms marksmanship accuracy. Quite frequently, the trigger is mounted in a manner that requires a certain amount of "slack" to be taken up during the initial finger pressure that is applied to the trigger. The balance of the squeeze is completed through a further application of steady finger pressure to the trigger until the firing pin is released. A failure to apply pressure steadily results in an uncontrolled "jerk" that usually pulls the firearm off target, causing a miss. Because trigger movement takes place only through a short distance, the pressure applied by the finger to the trigger can not be observed and the trigger "squeeze" sequence all takes place in a very brief time and, therefore, the trigger "squeeze" aspect of marksmanship presents one of the more difficult training problems.

Figure 10:
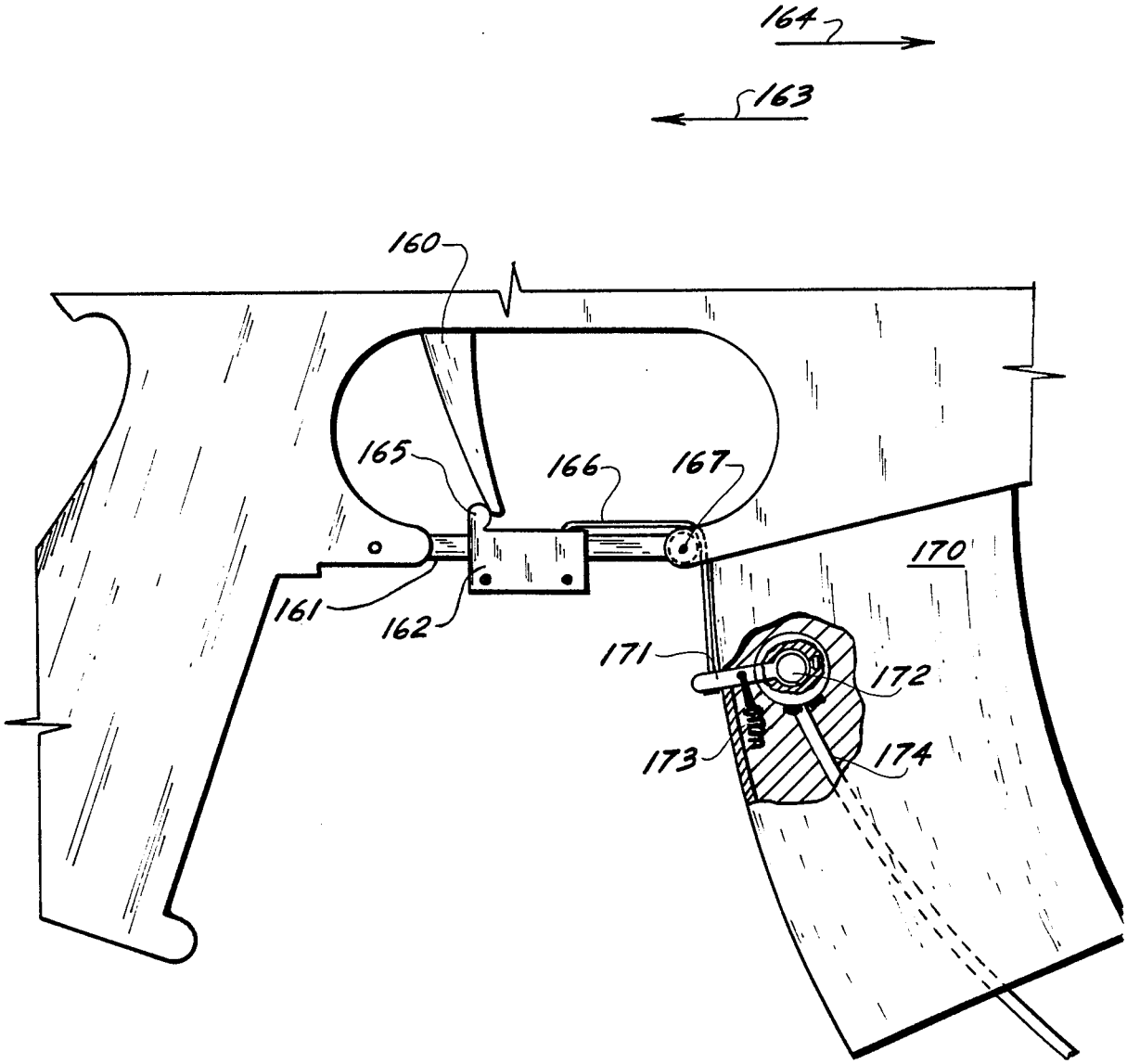
FIG. 10 is a schematic diagram of an apparatus for monitoring the character of the pressure applied to the trigger of a firearm.

An apparatus that improves trigger "squeeze" training is shown in FIG. 10. For example, the trigger 160 of a typical M-16 military rifle is protected by means of a peripheral trigger guard 161. Note, moreover, that there is a clearance between the trigger guard 161 and the end of the trigger 160.

In accordance with the invention, a sled, or traveller 162 is mounted on the trigger guard 161 for longitudinal movement in the directions of arrows 163,164. As shown, the traveller 162 has a protruding boss 165 that bears against the end of the trigger 160 on the side that is opposite to that to which finger pressure is applied during the trigger "squeeze". The boss 165 is sufficiently large to remain in contact with the trigger 160 throughout the full range of pivotal trigger movement.

A string 166, or the like, e.g. a series of levers or arms connected by pivot pins, is attached to the traveller 162. The string 166 is passed over a guide 167 and led downwardly in a direction that is generally parallel with the outer rear surface of a box magazine 170. The string 166 is secured to the rearwardly extending end of an arm 171 that protrudes from the rear surface of the magazine 170. The opposite end of the arm 171 is secured to the pivotally mounted control of a variable resistor 172 within the magazine 170. The central portion of the arm 171 is further connected to a biasing spring 173, in which the spring is also mounted within the magazine 170. The force orientation of the spring 173 is of a nature that it tends to draw the attached string 166 and the traveller 162 in the direction of the arrow 164.

Electrical connections 174 conduct signals from the variable resistor 172 to a suitable conversion circuit (not shown) to display graphically or otherwise the manner in which finger pressure is applied to the trigger 160. The analog input to the computer generated by a change in resistance would typically be converted to digital information and assessed by a computer program in order to diagnose improper trigger manipulation, provide the shooter with appropriate feedback, and provide appropriate remediation if required.

In operation, as pressure is applied to the trigger 160 to pivot the trigger rearwardly in the direction of the arrow 163, and thus to release the firing pin (not shown), the trigger movement also presses the traveller 162 in the same direction. Consequently, the string 166 also pulls the end of the arm 171 to which it is attached upwardly toward the trigger guard 161. The motion of the arm 171 is directly related to the character of the finger pressure that is applied to the trigger 160. Thus, a smooth, steady pressure on the trigger 160 is reflected in a similar movement of the arm 171. The electrical signal in the connections 174 from the variable resistor 172 also correspond to this applied pressure. Naturally, an undesirable "jerk" on the trigger 160 also will produce a generally directly related electrical signal in the connections 174. By displaying graphically the actual character of the trainee's trigger squeeze, the trainee can change the application of finger pressure more readily to match the desired ideal technique.

It should be further noted that the entire apparatus that characterize this illustrative embodiment of the invention can be swiftly attached to or removed from a conventional firearm in a manner that does not require any permanent alteration to the weapon. However, the apparatus can be placed permanently in the body of a dummy weapon if so desired.

In summary, the many features of the invention presented herein provide significantly improved marksmanship training and, if desired, arcade-type entertainment at much lower cost than that which heretofore was possible.

We claim:

1. A recoil and vibration simulation apparatus for attachment to an automatic weapon having a trigger comprising, a rotatable arm, a pair of hammers each attached to an opposite end of said arm for rotation with said arm, an anvil for selective movement into the path of said rotatable hammers for impact therewith, and at least one solenoid for driving said anvil into said hammer path in response to manipulation of the automatic weapon trigger.

2. An apparatus according to claim 1 further comprising, biasing means for pivoting said hammers relative to said rotatable arm to enable each of said hammers to clear said anvil after impact therewith.

3. An apparatus according to claim 1 further comprising, a belt for driving said arm in said rotation relative to said anvil.

* * * * *